US007918620B2

(12) United States Patent
Del Ponte

(10) Patent No.: US 7,918,620 B2
(45) Date of Patent: Apr. 5, 2011

(54) MAGNETICALLY MATED COSMETIC BRUSHES AND/OR APPLICATORS AND HOLDER THEREFOR

(75) Inventor: David J. Del Ponte, North Kingstown, RI (US)

(73) Assignee: Anisa International, Inc., Atlanta, GA (US)

( * ) Notice: Subject to any disclaimer, the term of this patent is extended or adjusted under 35 U.S.C. 154(b) by 1095 days.

(21) Appl. No.: 11/702,475

(22) Filed: Feb. 5, 2007

(65) Prior Publication Data

US 2007/0199575 A1 Aug. 30, 2007

Related U.S. Application Data

(60) Provisional application No. 60/771,080, filed on Feb. 6, 2006.

(51) Int. Cl.
*B43K 23/02* (2006.01)

(52) U.S. Cl. ..... 401/131; 401/195; 206/350; 206/818; 132/315; 132/317

(58) Field of Classification Search ..... 401/100, 401/131, 48, 195, 126, 129; 206/349, 350, 206/818; 132/313–317
See application file for complete search history.

(56) References Cited

U.S. PATENT DOCUMENTS

| | | | | |
|---|---|---|---|---|
| 2,540,340 | A * | 2/1951 | Linblade | 43/57.1 |
| 2,697,642 | A | 12/1954 | Rudy | |
| 2,725,038 | A * | 11/1955 | Morris | 401/100 |
| 2,866,993 | A * | 1/1959 | Edelstone | 401/100 |
| 3,363,775 | A * | 1/1968 | Shaw | 211/70.6 |
| 4,826,059 | A * | 5/1989 | Bosch et al. | 224/183 |
| 4,927,281 | A | 5/1990 | Gueret | |
| 5,063,947 | A | 11/1991 | Gueret | |
| 5,107,984 | A | 4/1992 | Welschoff | |
| 5,165,760 | A | 11/1992 | Gueret | |
| 5,339,483 | A | 8/1994 | Byun | |
| 5,482,059 | A | 1/1996 | Miraglia | |
| 6,035,865 | A | 3/2000 | Krieger | |
| 6,070,597 | A | 6/2000 | Motherhead | |
| 6,189,697 | B1 | 2/2001 | Davis | |
| 6,283,298 | B1 | 9/2001 | Seidler | |
| 6,516,555 | B2 * | 2/2003 | Buzzell | 43/57.1 |
| 6,532,970 | B2 | 3/2003 | Phue | |
| 6,546,937 | B2 | 4/2003 | Gueret | |
| 6,588,958 | B1 | 7/2003 | Seidler | |
| 6,591,842 | B2 | 7/2003 | Gueret | |
| 6,669,389 | B2 | 12/2003 | Gueret | |

(Continued)

FOREIGN PATENT DOCUMENTS

| | | |
|---|---|---|
| CN | 201067174 | 6/2008 |

(Continued)

OTHER PUBLICATIONS

International Search Report and Written Opinion dated Mar. 26, 2010, PCT Application No. PCT/US2009/004143.

(Continued)

*Primary Examiner* — David J Walczak
(74) *Attorney, Agent, or Firm* — Alston & Bird LLP

(57) ABSTRACT

An embodiment of a cosmetic applicator set comprises a holder for cosmetic applicators, which holder has within it a first magnetizable element, and at least one cosmetic applicator comprising a second magnetizable element. At least one of the first magnetizable element and the second magnetizable element is a permanent magnet.

1 Claim, 3 Drawing Sheets

U.S. PATENT DOCUMENTS

| | | | | |
|---|---|---|---|---|
| 6,681,936 | B2 | 1/2004 | Godshaw et al. | |
| 6,831,541 | B1 | 12/2004 | Seidler | |
| 6,866,046 | B2 | 3/2005 | Gueret | |
| 6,926,151 | B1 | 8/2005 | Perry et al. | |
| 6,974,513 | B2 | 12/2005 | Kepka | |
| 2001/0037815 | A1 | 11/2001 | Gueret | |
| 2002/0117423 | A1 | 8/2002 | Jackson | |
| 2004/0018037 | A1 | 1/2004 | Gueret | |
| 2004/0168700 | A1 | 9/2004 | Dorf | |
| 2005/0031401 | A1 | 2/2005 | Gueret | |
| 2005/0224392 | A1 | 10/2005 | Perry et al. | |
| 2007/0014624 | A1* | 1/2007 | Fogelson et al. | 401/131 |
| 2007/0199575 | A1 | 8/2007 | Del Ponte | |
| 2008/0283083 | A1 | 11/2008 | Piao et al. | |
| 2010/0017990 | A1 | 1/2010 | Piao et al. | |

FOREIGN PATENT DOCUMENTS

| | | | |
|---|---|---|---|
| JP | 57-018414 | | 1/1982 |
| JP | 2003-033228 | | 2/2003 |
| KR | 20-0432010 | | 11/2006 |
| KR | 20-0432010 | Y | 11/2006 |
| WO | WO 2009/054918 | | 4/2009 |
| WO | WO 2010011273 | | 1/2010 |

OTHER PUBLICATIONS

Office Action dated Apr. 5, 2010, U.S. Appl. No. 11/975,808.

International Search Report and Written Opinion dated Mar. 26, 2009, Application No. PCT/US2008/011883.

* cited by examiner

MAGNETICALLY MATED COSMETIC BRUSHES AND/OR APPLICATORS AND HOLDER THEREFOR

BACKGROUND OF THE INVENTION

The application of makeup requires the even distribution of cosmetics. To obtain a natural-looking application, while achieving the desired enhanced appearance of the wearer's eyes, cheek or face, the cosmetics are often applied using a variety of cosmetic brushes or applicators, each having a specific cosmetic application. Makeup can also be used to camouflage or hide certain undesired colors, blemishes, birthmarks, scars, or disfigurations on the face. It is also desirable that each brush have a handle of sufficient length to permit easy application of the cosmetics.

Cosmetics are often applied to the face by a brush or other applicator. Cosmetic brushes comprise a variety of sizes and shapes, wherein each brush is designed for a specific application or area of the face. A plurality of brushes can provide additional enhancement and definition to a specific area. For example, to enhance and accentuate the natural shape of the eyes, some individuals prefer to use different brushes that would define, contour and blend the applied makeup. Thus, the use of two or three different cosmetic brushes, appropriately sized for the selected area of the face, are useful to optimize the application and blending of the makeup. Because the bristles of cosmetic brushes are flexible, they move across the natural contours of the face enabling definition, contouring, blending, camouflaging and the addition of structure to the face by highlighting and shadowing certain features. For example, various types of applicators are used to apply blush to the cheek area, eye shadow to the eye area and camouflage or concealer to other areas of the face. As a result, conventionally one would typically use several brushes to obtain the desired results.

U.S. Pat. Nos. 4,927,281; 5,063,947; 5,165,760; 5,482,059 and many others describe brushes and processes for making brushes for applying a cosmetic product, in which a plurality of bristles transversely implanted in a core. For example, one type of brush generally comprises a core formed by two or more branches of a metal wire twisted into a helix. The bristles extend in the turns formed by the twisted branches. The tips of the bristles define a generally cylindrical outer surface having two diametrically opposed channels and application surfaces helically disposed along the length of the brush portion. The bristle portion, trimmed to desired shape, permits penetration of the eyelashes or hair.

In the alternative, cosmetic brushes are more like artist brushes, comprising a head of hairs, bristles or fibers enclosed by a metal or plastic ferrule. At the other end of the ferrule is attached a handle. The handle and the bristles of the brush are secured within the opposing ends of the ferrule by crimping and/or by an adhesive, such as glue. Metal ferrules of this type are known to be made of a variety of materials ranging from brass to light weight and inexpensive materials, such as aluminum. Advantageously such light weight materials are easily formed and pressed into place, and they are not corrosive or affected by the cosmetics used on the brushes. However, aluminum lacks the heft of brass for this purpose, and to avoid giving the appearance of being inexpensive a weight of steel, lead, or other inexpensive, but heavy material, may be included inside the ferrule, in the space left between the bristles and the handle affixed thereto. This added weight in the ferrule improves the balance, stability or heft of the brush when in the hand of the user.

Similarly cosmetic applicators, such as set forth, for example, by Kepka in U.S. Pat. No. 6,974,513 or U.S. Publ. Appl. 2003/0217759 that involve a predetermined pattern of flocking bristles are dispensed toward the applicator, may also include a ferrule type connector. See also a variety of inventions by Gueret, assigned to L'Oreal S. A., including U.S. Pat. Nos. 6,866,046; 6,669,389; 6,591,842; 6,546,937 and U.S. Publ. Appls. 2005/0031401; 2004/0018037; 2001/0037815 and others, wherein a plurality of rows of teeth are provided at multiple positions about the axis of the support, and may be configured as a brush.

When tools, such as cosmetic brushes or applicators, are not in use, they typically lie loose on a dressing table or on the surround of a lavatory sink, vanity, or the like. Keeping them in a pouch or case at home may simply be too much bother because the user wants the brushes and cosmetic applicators readily available for use. Yet the shape of cosmetics products, e.g. tubular lipsticks, highlighter pencil, cylindrical brushes and the like, renders the cosmetics products liable to fall off a surface on which they are placed. Likewise, cosmetologists also want their tools easily available, plus the cosmetologist is often confronted with limited work-space, meaning that cases or pouches consume the space in which they need to place their tools. In either case, although easy to access, the brushes and applicators are vulnerable to damage, and in a jumble on a counter-top, it may be hard to find the exact tool being sought since many brushes can have similar handles and appearances.

Similarly, when the brushes and applicators are being transported, since they may be needed for an occasional cosmetic touch-up, the user or the cosmetologist may simply scoop up a set of brushes or applicators from the counter-top and throw them loosely into a handbag. But, such unprotected transportation or storage of the brushes or applicators risks damage to the expensive bristles, and at the same time may result in smearing of the various cosmetics that remain in the brush or on the applicator from previous applications, between brushes and onto the user and the other contents of the handbag. Moreover, they may easily fall to the floor when they are used in a moving car or train, for instance.

A fitting solution to loosely carrying around a plurality of cosmetic brushes, applicators or other tools is to create a compact kit. For example, U.S. Pat. No. 5,107,984 (Welschoff) discloses a hinged cosmetic case specifically designed to transport multiple applicators in a handbag while protecting the applicators from soiling. Resilient applicator holders are mounted to the base of the cosmetic case. The applicator holders contain the brush heads, while the handles remain exposed within the cosmetic case to enable the user to keep hands and fingers clean. The carrying case is securely fastened with a locking mechanism contained within the carrying case. See also U.S. Publ. Appl. 2002/0117423 (Jackson) for a cosmetic packaging device within a housing, within which a plurality of interstices are disposed at pre-determined positions with the design in a manner coextensive with the housing. The Jackson case further accommodates a transparent retaining layer that includes magnets at the bottom of each interstice to receive and hold the containers, which may be either fully or partially made of metal to allow for magnetic attraction within the interstices, and makes them visible to a viewer.

In U.S. Pat. Nos. 6,831,541; 6,588,958; and 6,283,298, respectively, Seidler teaches a multi-stable magnetic article; an airtight magnetic applicator system; and an airtight container and method for filling a container with a cosmetic product. The multi-stable magnetic article defines a plurality of spaced apart parallel magnetic axes. In the various articles there is a first plate of non-magnetic material, and a plurality of spaced apart first magnets disposed in the first plate for movement therewith, and there is a second plate of non-magnetic material, and a plurality of spaced apart second magnets disposed in the second plate for movement therewith. The first and second plates are generally juxtaposed and independently transformable in respective parallel planes transverse to the axes between a stable closed orientation and a plurality of stable open orientations. In the stable closed orientation, the first and second plates are essentially superposed, and at least a plurality of the first magnets and the plurality of the second magnets form essentially superposed pairs. Each superposed pair contains one of the first magnets and one of the second magnets and defines one of the axes. In each of the plurality of stable open orientations, the first and second plates are overlapping, but essentially not superposed, and the first and second magnets of at least one of the superposed pairs of magnets in the closed orientation are essentially not superposed in the open orientation. In each of the superposed pairs, the first and second magnets are in the same magnetic orientation.

In U.S. Pat. No. 6,532,970, Phue teaches a plastic make-up case and kit comprising two sections. The first section includes a plurality of replaceable and interchangeable inserts-holders containing cosmetics supplies, such as eye shadows, lip color concealer, mascara, foundations, lipstick, blush, lip gloss, and the like (except powder). In the first section, there is compartment for holding brushes, including a shadow brush, or a lip brush, or a combination brush, one side of which is a shadow brush and the other side--a lip brush. The inserts are made of a magnetic material and are attached to the bottom of the case magnetically. A second compartment contains a removable tray with compact powder.

U.S. Pat. No. 6,035,865 (Krieger) provides a cosmetic holder assembly for detachably supporting a plurality of separate cosmetic containers, wherein within each separate container is provided an internal cavity for housing a resealable, cosmetic container. Each container, regardless of shape or size, is releasable supported by the support member, preferably by a post and bore, frictional-fit engagement means, although mention is made of other conventional and/or known quick release frictional, mechanical, magnetic or other mating coupling arrangements, e.g., threaded or threadable engagement means, Velcro®, releasable fasteners, cooperating magnets, etc.

However, such cases are bulky, cumbersome, and often heavy, making transport difficult when carrying other things or luggage. Because cosmetic brushes have easily damaged bristles and cosmetic applicators have easily damaged heads, they represent a significant investment that needs to be protected, while at the same time the brushes and applicators must remain readily available or they lose their value and purpose. Cosmetologists and those using cosmetics for personal use are constantly confronted with the need to store and protect such tools. To protect these investments from damage and loss while simultaneously trying to keep them clean and readily available, various types of kits and holders have been developed. Traditionally, bulky cases have been used, but such a conventional container, however, fails to prevent abrasion between the tools and the interior of the case or with other tools in the case and, thus, can result in scratches or breakage and fail to maintain the tools clean and in good condition, making use of a conventional tool box for delicate tools, e.g., cosmetic brushes or applicators, undesirable.

To improve upon bulky conventional tool boxes and for adding protection for the tools and to keep them in an organized fashion, various roll-up tool bags have also been designed. A conventional, roll-up tool bag includes a plurality of pockets with each pocket designed to receive an individual tool. Roll-up tool bags are typically made of a soft, flexible material that enables the bag containing the tools to be rolled for convenient, compact storage or transportation when the tools are not in use. Securing the tool bag in its rolled-up configuration is usually accomplished with circumferential straps or ties, thereby allowing for varying thickness of the bag because of a varying number of tools therein. The thickness of the rolled-up tool bag is dictated by the tools contained therein and the length/number of pockets of the tool bag. Such roll-up bags are provided, for example, by U.S. Pat. No. 6,681,936 (Godshaw et al.), wherein a series of pockets are provided from mesh panels, accessible through a zipper. The zippered pouch may, when folded back into the interior of the enclosure, include a mirror on the outside face thereof, or may be contoured to form a tray. See also U.S. Publ. No. 2005/0224392 (Perry); U.S. Pat. No. 6,189,697 (Davis) and U.S. Pat. No. 6,926,151 (Perry).

Thus, cosmetic brushes or applicators may be stored in a pouch or wallet within a user's purse or handbag. The pouch then typically includes a row of loops or tubular sleeves, within each, wherein the handle of each brush can be inserted. However, manufacturing the loops is complicated. In addition, when a brush is put away in the pouch, the handle of that brush must be inserted between the heads of the adjacent brushes. Inserting the brush without damaging the heads of the adjacent brushes or smearing cosmetic from any of the brushes onto the hand of the user is awkward. Therefore, although roll-up tool bags may help to prevent direct contact between the tools and aid in keeping the tools clean, they present another major drawback. When roll-up tool bags are unrolled and laid flat upon a horizontal surface, they occupy a significant amount of work- or counter-space. Alternatively, the tool bag may be attached to a vertical surface with hanging hooks, magnets or the like. However, it is recognized in the art that, particularly in cosmetology, it would be desirable to have the tools displayed for use in a vertical fashion to facilitate selection of the desired tool. Such manner of display advantageously permits quickly selecting a desired applicator, typically a brush, if all of the available applicators are vertically displayed in or on a holder that takes up little work surface.

Thus, it is apparent that there has been, prior to the present invention, an unfulfilled need for an improved means for storing, carrying and/or displaying full-size, cosmetic applicators, brushes or other tools that is lightweight and compact, while offering full functionality, effectiveness and productivity of the devices. Such a holder would not be bulky or cumbersome and permits such tools to be placed on and removed from the holder or displayed in a vertical manner, without the burden of sliding the handles endways into retaining loops or sleeves. Nevertheless it would keep the tools protected and, at the same time, readily available.

SUMMARY OF THE INVENTION

The present invention is directed to cosmetic brushes and other applicators, holders for tools, including cosmetic brushes and other applicators, and sets of brushes or other applicators or some combination thereof and holder therefor, that substantially eliminates or materially reduces disadvantages of the prior art.

An object of one embodiment of the present invention is to provide a holder and one or more tools, brushes or other applicators, comprising a magnetic element that holds the one or more tools, brushes or applicators in place on the holder. In particular, the embodiment encompasses cosmetic brushes and applicators, and a holder therefor, and more particularly it encompasses cosmetic brushes or other applicators having a ferrule. In addition, one or more bands or a cap of a magnetic material may be present. It is, thus, an object to provide such a brush or applicator, and a further object to provide such a holder.

It is a further object to provide such a holder, comprising a magnetized element that attracts a magnetic element in the applicator. Conversely, it is also an object to provide a brush or applicator/holder pairing, wherein the brush or applicator comprises a magnetized element that attracts a magnetic element in the holder. Moreover, it is yet another object to provide a brush or applicator/holder pairing, wherein both the holder and the brush or applicator comprise magnetized, magnetizable, or otherwise magnetic elements.

The magnetizable, magnetized or otherwise magnetic element on the holder may be an elongated element, to which several brushes and/or applicators can be attached side by side, wherein each brush or applicator is held in the vertical position on the holder. Moreover, such a magnetizable, magnetized, or otherwise magnetic element on the holder may be concealed within or as part of the holder. On the brush or applicator or other tool, the magnetizable, magnetized or otherwise magnetic element comprises the metal ferrule or is concealed within the ferrule, or in the alternative, the brush or applicator further comprises at least one additional magnetizable, magnetized or otherwise magnetic cap or band element spaced along the length of the handle of the brush or applicator. The latter brush or applicator is thus held in place on the holder at either of the points defined by the magnetic elements, or preferably at a plurality of points, making it less likely to rotate out of its desired position. The thus-mentioned holder may be an element in a pouch or carrying kit for transporting the brushes or applicators in an efficient and effective manner, or it may be part of a stand, base, cylinder or other free-standing support device that holds the brushes and/or applicators in a separated, vertical position readily available for use, display, or storage.

Additional features, objects and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. However, the detailed description accompanying each Figure is not intended to limit the scope of the claims appended hereto

DETAILED DESCRIPTION OF CERTAIN PREFERRED EMBODIMENTS

Figure 1:
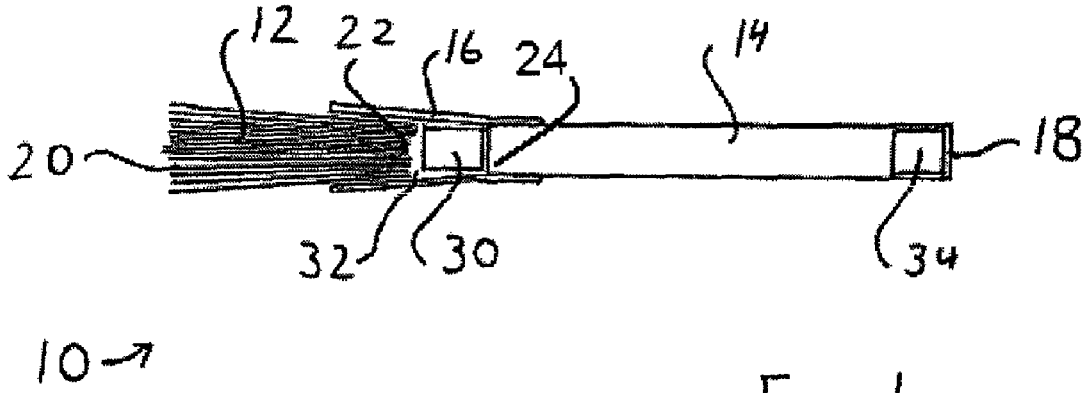
FIG. 1 is a side view, partly cut away, of a cosmetic brush in accordance with an embodiment of the invention.

Reference will now be made in detail to preferred and alternative embodiments of the present invention, examples of which are illustrated in the accompanying drawings. Like elements have the same numbers throughout the several views. However, techniques, systems and operating structures in accordance with the present invention may be embodied in a wide variety of sizes, shapes, forms and modes, some of which may be quite different from those in the disclosed embodiment. Consequently, the specific structural and functional details disclosed herein are merely representative; yet in that regard, they provide a basis for the claims herein which define the scope of the present invention. Although the illustrated embodiments are merely exemplary of systems for carrying out the present invention, both the organization and method of operation of the invention, in general, together with further objectives and advantages thereof, may be more easily understood by reference to the drawings and the following description.

The present invention provides a holder and one or more tools, brushes or applicators, comprising an elements in the holder and in the tools that magnetically mate and hold the one or more tools, brushes or applicators in place on the holder. In particular, the invention encompasses cosmetic brushes and applicators, and a holder therefor, and more particularly it encompasses cosmetic brushes or applicators having a ferrule. As used herein, the term "magnetic" denotes a material capable of ferromagnetic or other substantial attractive magnetism, whether or not that material is magnetized. "Magnet" denotes a magnetic material that has a substantial magnetic polarity, and thus produces a substantial magnetic field outside itself, and that retains that polarity in use largely regardless of the presence or absence of any magnetic field from another source. "Magnetized" denotes a material that has substantial magnetic polarity, whether induced by the presence of an external field or because the material is a "magnet." "Magnetizable" denotes a magnetic material that becomes magnetized, or becomes more strongly magnetized, when a magnetic field from another source is applied, but loses at least a large part of its magnetization when the applied field is removed. For this purpose, the magnetic fields that are appropriate to the practice of the present invention are considered. For example, many "magnetizable" materials usable in the present invention can be permanently magnetized to become magnets by a stronger magnetic field. Different materials produce magnets of different strengths.

Magnetic ferromagnetic materials are generally graded as "hard" or "soft." A magnetically soft material is easy to magnetize by exposing it to an external magnetic field, but easily loses its magnetization when the external field is removed. A magnetically hard material is less easy to magnetize, but can retain more of its magnetization after the external field is removed. Permanent magnets are magnetically hard materials that have been magnetized.

A strong magnetic attraction between two objects can be achieved by two permanent magnets. However, the two permanent magnets must then be correctly aligned to produce an attractive force. Alternatively, a strong magnetic attraction can be achieved by one permanent magnet together with an element of magnetizable material that is magnetized by the field of the magnet. A magnetically soft material may be preferred for the element of magnetizable material. However, to attach and support the weight of a cosmetic brush or other applicator or other small tool in a holder, a very strong magnetic field is not required, and steel magnets and elements of magnetizable steel may be used, thereby creating a static magnetic field between the two components.

By "tool" is meant virtually any tool having a magnetic component or having a handle into which a magnetic component may be inserted or having an element attracted to a magnet, e.g., screwdriver, nutdriver, wrench, brush, pliers, scraper, knife, pen, pencil, scalpel, etc, and further includes a plurality and/or variety of a particular type of tool, e.g., multiple screwdrivers, etc. In one embodiment, the tools are specific to cosmetology, comprising without limitation, such tools as a brush or applicator, lipstick, eyeliner, mascara pencil, eyebrow pencil, spatula, and the like. In a preferred embodiment, the tools are a variety of cosmetic brushes or applicators or artist's brushes, each having a ferrule connecting the tufts of hair, bristles or fibers forming a brush head to a handle, as described in greater detail below. The term "bristle" is used to collectively refer to any hair, bristle or fiber used to form the brush head, and shall further refer to any adaptation, such as flocking, that may be used on the head end to cause the brush to be used as an applicator. Cosmetic brushes and applicators, including those comprising a ferrule, are well known to one skilled in the art, and since the shape of the brush itself is not an element of the invention, further description is not needed to permit one to understand the variety of shapes and sizes that may be used. Of course, the exact tool will be dictated by the needs of the user. Consequently, those skilled in the art will recognize that both cosmetologists and artists use a variety of brushes and other tools to accomplish their respective arts, and when the present invention is used to hold artist's tools, such tools may comprise, without limitation, brushes, drawing pencils, charcoal sticks, etc. A multi-brush cosmetic set can be any combination and/or number of cosmetic brushes or applicators, but might typically include, for example, a cheek brush, an eye defining brush, an eye contouring brush, an eye blending brush and/or a camouflage or concealer brush.

By "holder" is meant any free-standing holder of tools, e.g., cosmetic brushes or applicators, for use on a surface, such as a tabletop, dressing table, counter, lavatory surround, etc., or any pouch, purse, roll, or other holder for transporting same, wherein each holder comprises a magnetic component or an element attracted to a magnet, e.g., that permits the tools to extend from, be held in place by and be clearly visible as to size or type when compared to a conventional case or tool holder that must lie flat upon a work surface.

Referring initially to FIG. 1, cosmetic brush 10 may be of any size, shape or material without limitation. By way of example, cosmetic brush 10 has a head 12, comprising hairs, bristles or fibers, and a handle 14 that is generally linear and cylindrical in shape, having a round, oval, square or other suitable cross section, joined together by a ferrule 16. Alternatively, handle 14 may vary in cross section along its length, or may be of a cross sectional shape other than the aforementioned, or both. For example, many handles 14 for cosmetic brushes taper from ferrule 16 to free end 18. Moreover, for example, some cosmetic brush handles 14 are flattened in cross section. Head 12 may be substantially circular in cross section or may be flattened, and may or may not become wider or narrower from ferrule 16 towards a tip 20. The shape of tip 20 is dictated by its intended purpose, and is not within the scope of the present invention. When a set of cosmetic brushes 10 is provided, the different brushes in the set may be the same or of different shapes and sizes, and often have differently shaped tips 20.

The bristles forming head 12 can all be the same length, such that the tip portion of brush 10 is substantially flat along its tip 20. Alternatively, the bristles vary in length, such that the tip 20 of brush 10 is curved, is angled, comes to a point, or has a leading edge which then angles back to the shortest point of the bristles of the brush, or maintains a substantially curved shape to conform to the contours of the eye, cheek or any area on the face, or is another desired shape. In further alternative embodiments, adjacent bristles may vary greatly in length. This gives the tuft a softer feel to the skin, and allows for smoother application of the cosmetic across the contour of the face.

Ferrule 16 may be shaped and sized to fit closely over a rear end 22 of head 12 at one end, and to fit closely over a forward end 24 of handle 14 at the other end, and is shaped to fit the two components. For example, if both head 12 and handle 14 are circular in cross-section, ferrule 16 may be similarly circular in cross-section. If either head 12 or handle 14 has a flattened cross-section, ferrule 16 may be correspondingly flattened in cross-section. Such an adaptation of the ferrule to the shape of the components would be known to one skilled in the art. Preferably, ferrule 16 is made of metal, plastic, hard rubber or other polymer. Common metals for such purpose, include tin, nickel, aluminum, brass or an alloy thereof. Often for economy purposes ferrule 16 is made of a soft, readily available, light-weight metal, such as aluminum. The aluminum is either bare or coated with a decorative covering, such as paint, varnish or other suitable material that adheres to ferrule 16. A magnetic element 30 is placed inside the ferrule, between rear end 22 of head 12 and forward end 24 of handle 14.

In an embodiment of cosmetic brush 10, magnetic element 30 is a steel permanent magnet, to cooperate with an element of unmagnetized, but magnetizable steel in a support member in the holder. In another embodiment of brush 10, magnetizable element 30 is an element of unmagnetized, but magnetizable steel, to cooperate with a steel permanent magnet in a support member in the holder. The strength of the magnet or magnets is selected so that brush 10 is held securely to the support member in the holder, but can be lifted away from the support without undue difficulty by the user of brush 10.

Figure 5:
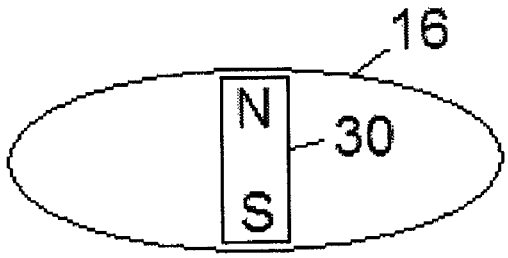
FIG. 5 is a cross-sectional view of a ferrule in accordance with an embodiment of the invention.

When magnetic element 30 is a magnet, it may be aligned with its polar direction (the direction through the North and South magnetic poles) in a desired direction. Referring briefly to FIG. 5, according to one embodiment of the present invention, ferrule 16 may be flattened so that brush (not shown) will tend to lie with one of two opposite flat sides of ferrule 16 against a support. In this case, magnet 30 may be aligned with its polar direction towards the flat sides, in order to direct the magnetic field towards the support.

Referring back to FIG. 1, in other embodiments, the ferrule 16 may be circular in cross section, and magnet 30 may be aligned with its polar direction facing along the length of brush 10, in order to produce a uniform magnetic field around ferrule 16. Such a uniform magnetic field reduces the possibility that brush 10 may fail to attach to the support if brush 10 is placed with magnet 30 sideways on to the support, or that brush 10 may twist into a non-vertical position as magnet 30 engages with a magnetic element in the support.

As noted above, ferrule 16 may be made of aluminum, plastic, or other material that is not magnetic, and therefore, does not interact with magnetic fields. If a magnetic ferrule 16 were to be used, the ferrule might act to disperse the magnetic field between magnetic element 30 and the support along the length of the ferrule. In the alternative, it might prevent the magnetic field from penetrating ferrule 16, to a sufficient extent to weaken the magnetic attraction holding brush 10 to the support. Either of those effects would require a stronger magnet to achieve a desired force attaching magnetic element 30 to the support, which may not be desired.

In an embodiment of the cosmetic brush of the present invention, within ferrule 16, rear end 22 of head 12, forward end 24 of handle 14, and magnetizable element 30 are secured to each other, and to the ferrule, by an adhesive, such as glue 32, as shown in FIG. 1. Such adhesives are well known in the art. The rear ends of the bristles forming head 12 are embedded in and secured by adhesive 32. The adhesive 32, therefore, substantially fills any space within ferrule 16.

In an alternative embodiment, brush 10 further comprises a second magnetic element 34, spaced apart from magnetic element 30. The second magnetic element 34 is spaced at a sufficient distance from the magnet in the ferrule so that the two magnets do not interact. For example, element 34 may be embedded in or placed over free end 18 of handle 14. For example, the additional magnetic element is a band or cap in or on handle 14. When brush 10, having two (or more) magnetizable elements 30 and 34 is placed in or on a holder that has two corresponding magnetizable elements, brush 10 is secured to the holder at two places, reducing the possibility that the brush 10 will rotate about magnetizable element 30 and become displaced from its desired position. Although not necessary, more than two magnetizable elements may be added to the holder and correspondingly on the brush, and such use of a plurality of magnetizable elements is also encompassed by this invention.

Figure 2:
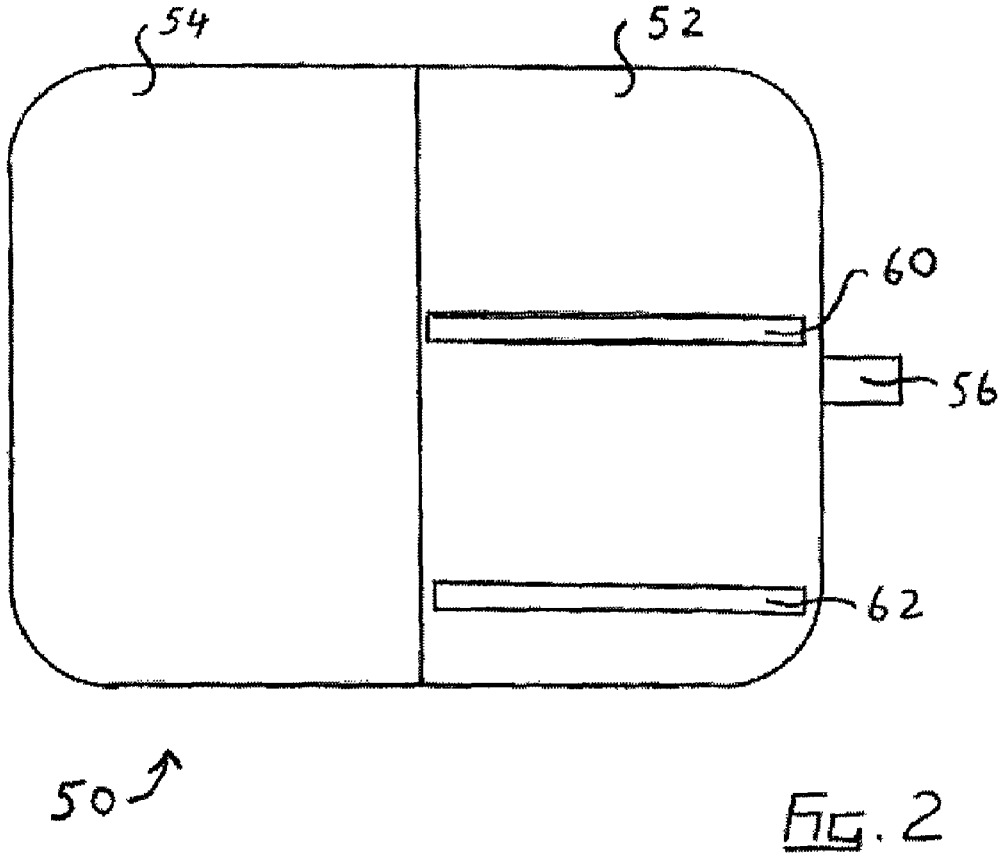
FIG. 2 is a front view of a pouch for holding cosmetic brushes in accordance with an embodiment of the invention.

Referring now to FIG. 2, one embodiment of a holder for a cosmetic brush 10 comprises a pouch 50 having a body 52, a cover 54 that can be closed over body 52, and a clasp 56 to secure cover 54 when in the closed position over the body 52. The term "pouch" is used herein, but it is intended to include all types of pouches, wallets, roll-up carriers, purses, handbags, and the like. The "clasp" is meant to encompass any known suitable closure means including clasps per se, snaps, buttons, buckles, hook-and-loop closures such as those sold under the trademark Velcro®, zippers and the like. A magnetic element 60 is provided in or on body 52 to hold in place cosmetic brushes or applicators or other tools attached thereto. As shown in FIG. 2, magnetic element 60 is a strip of magnetic material extending across the body 52. Where the magnetic elements 30 of the brushes 10 are permanent magnets, the strip of magnetic metal 60 may be unmagnetized but magnetizable material. Where the magnetic elements 30 of the brushes 10 are unmagnetized, the strip of magnetic material 60 is in general a permanent magnet with its polar direction transverse to the length of the strip, either vertically up and down body 52, or out of the plane of the body 52, so as to provide a magnetic field all along the strip of magnetizable metal 60.

The strip of magnetic material 60 may be rigid or, especially where the pouch, which may be a purse, wallet, roll-up carrier, or the like 50 is flexible, or in the alternative, the strip of magnetic material 60 may be flexible. Where the strip of magnetic material 60 is flexible, it may comprise particles of magnetic material, for example, iron or steel powder, in a flexible, for example, plastic or rubber, matrix. Pouches of this type, made from fabric, leather, vinyl or any of a variety of flexible materials are well know in this art, and are adaptable for many purposes. Where magnetic strip 60 is rigid, it may be a strip of iron, steel, or other ferromagnetic metal or alloy. Although none have been previously disclosed comprising magnetic strip 60 disclosed herein, in light of the present disclosure, one would know how to add such a magnetic strip 60. Such pouches may, of course include other pockets or divisions (for example, to carry the cosmetics to be applied) in addition to magnetic strip 60, and such pouches would be encompassed by the present invention, however, to reduce the size of the pouch for the intended purpose of transporting and/or storing cosmetic brushes and applications, the portion of the pouch comprising magnetic strip 60 is the significant element of the pouch for the present invention.

Moreover, magnetic strip 60 may be mounted onto body 52, so as to be visible to the user; or in the alternative, magnetic strip 60 may be within or under a surface layer of body 52. The latter may be for reasons of appearance or because magnetic strip 60 is mounted in a pocket (not shown in detail) within body 52. When magnetic strip 60 is under a surface layer of body 52, the shape of the strip may be visible, even if the strip itself is not visible. When magnetic strip 60 is completely concealed, visible indicia may be provided on the surface of the body 52 to show the correct position for the attachment of each brush 10, so that magnetic element 30 of each brush 10 properly engages with magnetic strip 60.

When magnetic strip 60 is not exposed, magnetic strip 60 is preferably covered only by only a thin surface layer of body 52, because the strength of the magnetic attachment between magnetizable element 30 and magnetic strip 60 can decrease markedly if there is too large a separation between them. Materials suitable for such covering include, for example, but without limitation, such durable, but flexible materials, such as fabric, vinyl, leather, nylon, nonmagnetic foils, and the like. Those skilled in the art are familiar with methods of affixing such a piece of flexible material to a metal strip, even though the materials are dissimilar.

Alternatively, a configuration in which both magnetic element 30 of brush 10 and magnetic strip 60 are permanent magnets is further encompassed by the present invention. For example, magnetic element 30 of brush 10 may have its North pole towards head 12, and magnetic strip 60 would then have its North pole down body 52, or vice versa. A strong magnetic attraction then occurs when brush 10 is placed on body 52 of pouch 50 with head 12 of the brush upwards. The converse is also encompassed. Further, the configuration is intended to hold multiple brushes or applicators in alignment on magnetic strip 60, or several lines of brushes or applicators may be aligned in more than one row on a plurality of magnetic strips 60. However, the strong magnetic attraction will occur only if magnets 30 are level with magnet strip 60. If one brush 10 is placed on body 52 in a position that is too high or too low, the brush will slide or jump into the correct position. This configuration is, therefore, be preferred for example, when there is a mechanical guide, or a clear visual indication, leading the user to place brush 10 at the correct position.

Especially where magnetic strip 60 is a permanent magnet with its polar direction out of the plane of body 52, a yoke of magnetically soft material (not shown) may be provided behind magnetic strip 60. The yoke is arranged to collect the magnetic field from the pole facing away from brushes 10 and guide the field back towards brushes 10 above and/or below magnetic strip 60. Such a yoke may reduce the strength of the magnet needed, by making more efficient use of the strength available. The yoke may also reduce the "stray" magnetic fields escaping from pouch 50, and may thus reduce the risk that a stray magnetic field might interfere with other objects, for example, by corrupting data on the magnetic strips of credit cards stored in the same purse, adjacent to pouch 50. A yoke (not shown) may also be provided in cover 54, positioned so as to overlie magnetic strip 60 when cover 54 is closed.

In an alternative embodiment, body 52 comprises a second strip of magnetic material 62 corresponding to second magnetizable element 34. In this embodiment, brush 10, having second magnetic element 34, is placed on body 52 with magnetic element 30 attached to magnetic strip 60, with second magnetic element 34 attached to second magnetic strip 62. The provision of two separately spaced points of attachment provides a more secure and stable mounting of brush 10 on body 52, thus reducing the risk of the brushes turning sideways and coming into contact with each other about a single point of attachment. However, the cost of additional materials may off-set the desire to add such a second point of attachment, making the single point embodiment more commercially useful.

Figure 3:
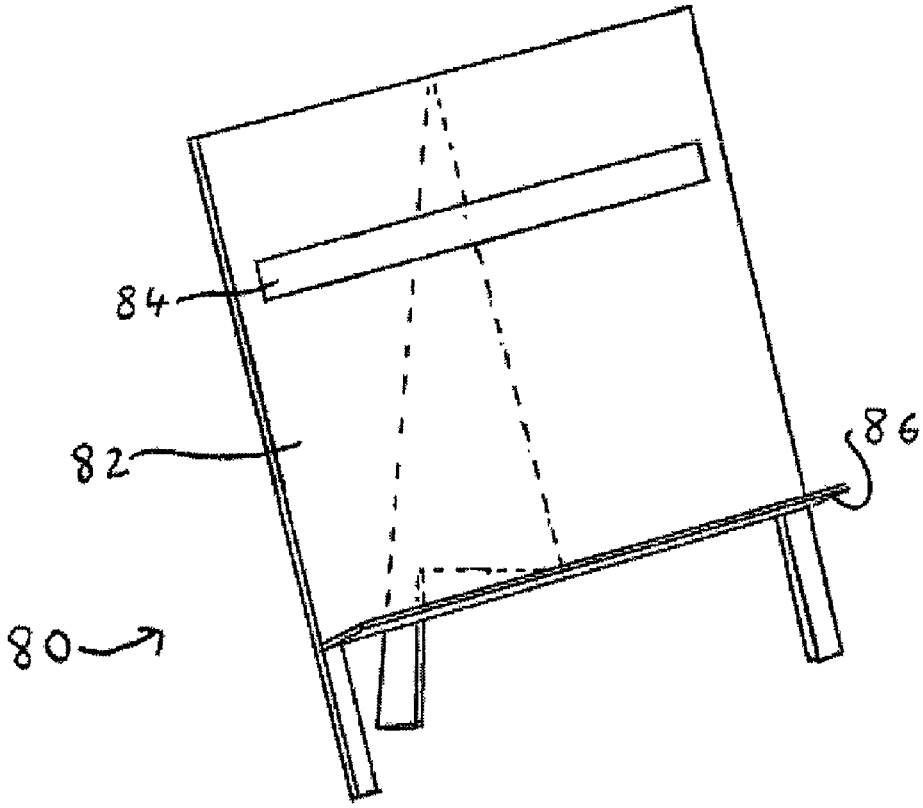
FIG. 3 is a front view of a stand for holding cosmetic brushes in accordance with an embodiment of the invention.

Referring now to FIG. 3, an alternative embodiment of a holder for brush 10 (or for multiple brushes or applicators as described above) comprises a stand or easel 80 that may be placed on a dressing table, vanity, or sink surround, etc. Easel 80 comprises a carrying surface 82 that has a strip of magnetic material 84, similar to strip 60, mounted across carrying surface 82. Carrying surface 82 may be in several configurations, including sloped back slightly from the vertical, and/or it may have a shelf 86 along the bottom edge to support the free ends 18 of each handle 14 of each brush 10, when brush (es) 10 are attached to the strip of magnetic metal 84. Shelf 86 and the slope of carrying surface 82 are not necessarily functionally necessary, but give a visual appearance that brush(es) 10 are more stably mounted. This is especially preferable if magnetic strip 84 is concealed under a surface layer of carrying surface 82.

Figure 4:
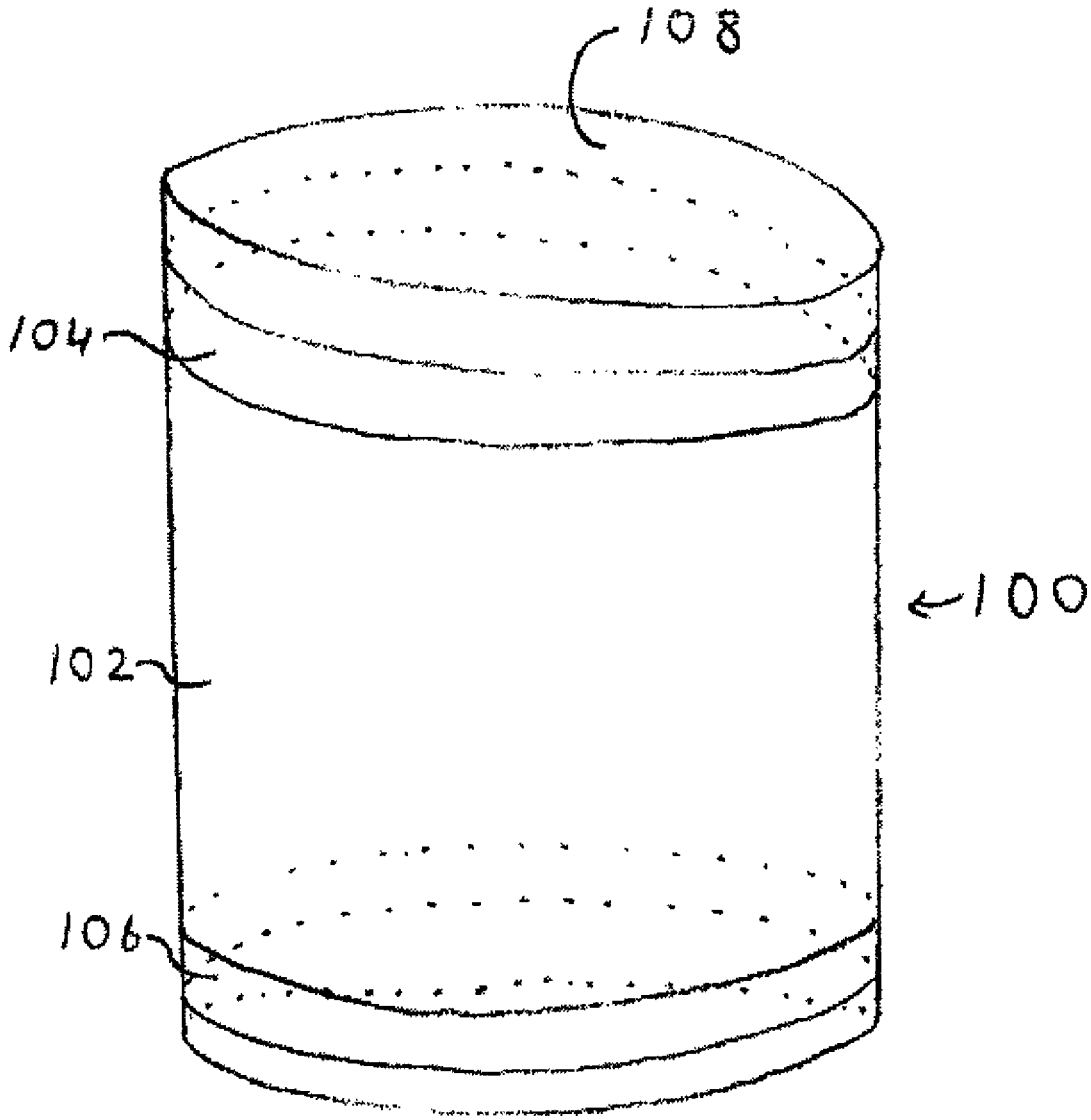
FIG. 4 is an oblique view of a canister for holding cosmetic brushes in accordance with an embodiment of the invention.

Referring now to FIG. 4, a further alternative embodiment of a holder for brush 10 (or for multiple brushes or applicators as described above) comprises a cup or canister 100 that may be placed on a dressing table, vanity, or sink surround, etc. Cup 100 is generally cylindrical with an upright exterior surface 102. In plan view, cup 100 may be circular, square, or of another suitable shape. Cup 100 has a strip of magnetic material 104, similar to strip 60, encircling cup 100 near the top of exterior surface 102. Brushes 10 can be attached to outside surface 102 of cup 100 by attaching magnetic elements 30 of brushes 10 to magnetic strip 104. A second magnetic strip 106 may encircle cup 100 near the bottom of exterior surface 102 to attach to magnetic elements 34 on brushes 10, if present. If cup 100 is thin, magnetic strip 104 may also enable brushes 10 to be attached to the inside surface 108 of cup 100. Alternatively, the interior of cup 108 may be used for a number of purposes such as storing cosmetics, hand towels, any other personal item a cosmetologist or someone using the cosmetic brushes or applicators for personal use would like to keep in such close proximity to the stored brushes or applicators.

Various modifications and variations are encompassed by the present invention without departing from the spirit or scope of the invention. For example, pouch 50 shown in FIG. 2 comprises only a holder for brush(es) 10. Alternatively, pouch 50 could include holders for applicators and/or cosmetics to be applied with brush(es) 10, a mirror to assist the user in applying cosmetics, or even personal items, such as a miniature wallet for carrying money or identification, or any combination thereof.

Pouch 50 shown in FIG. 2 has magnetic strips 60 and 62 positioned parallel to one another. However, when pouch 50 is intended to hold a set of brushes 10 having handles of different lengths, the pouch may alternatively have magnetic strips 60 and 62 positioned obliquely to one another, so that brush(es) 10 can be arrayed in order of length with the spacing between magnetic strips 60 and 62 fitting all of the brushes.

In FIGS. 2 and 3 magnetic strips 60, 84 are shown as forming, or placed under, a flat surface 52, 82 against which brush 10 is placed. Alternatively, pouch body 52 or carrying surface 84 is provided with a cradle having a row of recesses, and a brush is then placed into each recess. The cradle then serves to prevent the brushes from being displaced sideways along magnetic strip 60 or 84, and to keep the brushes evenly spaced, so that each brush can be easily and securely grasped by the user and lifted from the carrying surface without disturbing any of the other brushes. The recesses may be open fronted, because the magnetic force holds the brushes into the cradle.

Where the magnetic elements 30, 60 are unmagnetized, they may alternatively be provided by forming carrying surface 52, 84 from a sheet of magnetizable material. This may be particularly suitable where the holder is a free-standing, rigid device, such as easel 80 or cup 100. Carrying surface 84 may then be formed using a thin sheet of lightweight metal, which can be economical and robust, without providing excess weight to the holder. A heavy holder is not usually desired for a portable holder, such as pouch 50 to be carried in a purse, but can be helpful for a free-standing device, where the user wants to be able to remove brushes 10 without having to use her other hand to hold the holder in place. Additional weight may be added to the base of easel 80 or cup 100 for that purpose, so that when the brushes are removed, the holder does not topple over or slide across the surface on which it rests. Suction cups or non-slip rubber pads made be further added to the holder for this purpose in a manner well known in the art of display items.

The strength of the magnetic fields, and thus the strength of the attachment of brush 10 to holder 60, 80, 100 is determined by the shape, size, and material of magnetic elements 30, 34, 60, 62, 84, and by the spacing between the cooperating magnetic elements. Those skilled in the art understand how to manipulate these factors to produce an appropriate strength of attachment for a specific purpose. Where brushes 10 are placed on easel 80, which stands on a work surface, a light attachment is typically sufficient, because easel 80 is seldom subjected to violent forces, and the user wishes to be able to remove brushes 10 with one hand. Where brushes 10 are carried in pouch 50, which may be jolted around in the user's purse, a stronger attachment is desirable. The user then holds pouch 50 in one hand while removing a brush 10 with the other hand, so the stronger attachment force is easily overcome. Where the same brushes 10 are used with pouch 50 and with easel 80, and where brushes 10 have magnets and easel 80 has a simple metal strip 84, the magnetic attraction between magnets 30 and metal strip 84 can be weakened by embedding metal strip 84 relatively deeply in carrier surface 82.

In an alternative embodiment, a part of holder 50, 80 including magnetic strip 60, 84 may be removed from one holder and transferred to another holder. For example, carrying surface 84 may be placed as a liner in pouch body 52. The transferable part of the holder can be transferred with brushes 10 remaining attached to magnetic strip 60, 84 during the transfer.

The pouch 50 may be provided with a hanging strap such as might be attached to the back of pouch body 52, so that pouch 50 may be worn as a belt or on a belt, or pouch 50 may easily be hung from a hanger for easy access when traveling.

The disclosures of each patent, patent application and publication cited or described in this document are hereby incorporated herein by reference, in their entirety.

While the foregoing specification has been described with regard to certain preferred embodiments, and many details have been set forth for the purpose of illustration, it will be apparent to those skilled in the art without departing from the spirit and scope of the invention, that the invention may be subject to various modifications and additional embodiments, and that certain of the details described herein can be varied considerably without departing from the basic principles of the invention. Such modifications and additional embodiments are also intended to fall within the scope of the appended claims and their equivalents.

What is claimed is:

1. A cosmetic set comprising:

a plurality of brushes or applicators each including a first magnetic material;

a pouch, comprising:

a body;

a cover movable between an open position and a closed position; and a plurality of magnets positioned on or in the body so as to provide spaced points of removable attachment for the plurality of brushes or applicators;

at least one of the brushes or applicators including a flattened ferrule including a permanent magnet having poles aligned transverse to an elongate dimension of at least one of the magnets positioned on or in the body; and the cover in its closed position covering the brushes or applicators.

* * * * *